US005933511A

United States Patent [19]

Garth, Sr.

[11] Patent Number: 5,933,511

[45] Date of Patent: Aug. 3, 1999

[54] HANDS-FREE AMPLIFICATION SYSTEM

[76] Inventor: John R. Garth, Sr., 3921 New Orleans Ave., Egg Harbor City, N.J. 08215

[21] Appl. No.: 08/897,907

[22] Filed: Jul. 21, 1997

[51] Int. Cl.[6] ..... H04R 11/04; H04R 17/02; H04R 19/04

[52] U.S. Cl. ..... 381/367; 381/361

[58] Field of Search ..... 381/374, 375, 381/376, 380, 381, 382, 378, 385, 361, 370, 371, 372, 373, 362, 363, 364, 367; 128/200.24, 201.19, 206.16, 206.17

[56] References Cited

U.S. PATENT DOCUMENTS

| | | | |
|---|---|---|---|
| 2,676,738 | 10/1954 | Herrick | 381/385 |
| 2,937,244 | 10/1960 | Weinger | 381/385 |
| 3,190,974 | 6/1965 | Vasicek | 381/378 |
| 3,314,424 | 4/1967 | Berman | 381/367 |
| 3,540,442 | 11/1970 | Holloway | 381/367 |
| 3,850,168 | 11/1974 | Ferguson et al. | 381/367 |
| 4,070,553 | 1/1978 | Haas | 381/385 |
| 4,072,831 | 2/1978 | Jocelyn | 381/385 |
| 4,259,747 | 4/1981 | Taesler et al. | 381/367 |
| 5,159,641 | 10/1992 | Sopko et al. | 381/367 |
| 5,224,473 | 7/1993 | Bloomfield | 381/367 |
| 5,224,474 | 7/1993 | Bloomfield | 381/169 |
| 5,428,688 | 6/1995 | Becker et al. | 381/367 |
| 5,463,693 | 10/1995 | Birli et al. | 381/367 |
| 5,503,141 | 4/1996 | Kettl et al. | 381/361 |
| 5,533,131 | 7/1996 | Kury | 381/361 |
| 5,701,356 | 12/1997 | Stanford et al. | 381/367 |

*Primary Examiner*—Paul Loomis
*Assistant Examiner*—Rexford N Barnie

[57] ABSTRACT

An amplification system for use in conjunction with a device which precludes readily access to a mouth of a user is provided. Such system includes a microphone for receiving audio signals from an ear of a user when the user vocalizes. Next provided is a cord having a first end connected to the microphone and a second end with a jack formed thereon. Also included is an amplifier housing having a rectilinear configuration with a square front face, a square rear face, a rectangular top face, a rectangular bottom face, and a pair of rectangular side faces coupled therebetween. A spring biased rectangular clip is included having a first end hingably coupled to the rear face of the housing adjacent the top face thereof. The clip has an unbiased orientation with a second end abutting the rear face of the housing and a second orientation wherein the second end of the clip is distanced from the housing. An input port is adapted to releasably receive the jack of the coiled cord and further receive the audio signals. Finally, a speaker is situated on the front face of the housing and connected to the input port for emitting the audio signals therefrom.

9 Claims, 2 Drawing Sheets

HANDS-FREE AMPLIFICATION SYSTEM

BACKGROUND OF THE INVENTION

1. Field of the Invention

The present invention relates to amplification systems and more particularly pertains to a new HANDS-FREE AMPLIFICATION SYSTEM for mounting an amplification system on a user without interfering with various other equipment being concurrently worn.

2. Description of the Prior Art

The use of amplification systems is known in the prior art. More specifically, amplification systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art amplification systems include U. S. Pat. No. 4,289,938; U.S. Pat. No. 5,428,688; U.S. Pat. Des. 247,966; U.S. Pat. No. 4,588,867; U.S. Pat. No. 5,363,444; and U.S. Pat. No. 5,280,524.

In these respects, the HANDS-FREE AMPLIFICATION SYSTEM according to the present invention substantially departs from the conventional concepts and designs of the prior art, and in so doing provides an apparatus primarily developed for the purpose of mounting an amplification system on a user without interfering with various other equipment being concurrently worn.

SUMMARY OF THE INVENTION

In view of the foregoing disadvantages inherent in the known types of amplification systems now present in the prior art, the present invention provides a new HANDS-FREE AMPLIFICATION SYSTEM construction wherein the same can be utilized for mounting an amplification system on a user without interfering with various other equipment being concurrently worn.

The general purpose of the present invention, which will be described subsequently in greater detail, is to provide a new HANDS-FREE AMPLIFICATION SYSTEM apparatus and method which has many of the advantages of the amplification systems mentioned heretofore and many novel features that result in a new HANDS-FREE AMPLIFICATION SYSTEM which is not anticipated, rendered obvious, suggested, or even implied by any of the prior art amplification systems, either alone or in any combination thereof.

To attain this, the present invention generally comprises a microphone with an earpiece. Such earpiece is adapted to be frictionally situated within an ear of a user. Note FIG. 1. In use, the microphone serves to receive audio signals when the user vocalizes. Next provided is a coiled cord having a first end connected to the microphone and a second end with a jack formed thereon. Such jack is equipped with a locking mechanism. The locking mechanism includes a tab with a first end coupled to an interior surface of the jack. An arcuate extent extends through a first opening in the jack. Such first opening is situated a first distance from the second end of the cord. The tab further has a triangular extent extending through a second opening in the jack a second distance from the second end thereof which is greater than the first distance. By this structure, the triangular extent is adapted to lower within the second opening upon the depression of the arcuate portion. As shown in FIGS. 2 & 3, an amplifier housing is provided having a rectilinear configuration. The housing has a square front face, a square rear face, a rectangular top face, a rectangular bottom face, and a pair of rectangular side faces coupled therebetween. Shown in FIG. 3 is a spring biased rectangular clip having a first end hingably coupled to the rear face of the housing adjacent the top face thereof. The clip has an L-shaped lip formed on a second end thereof. In use, the clip has an unbiased orientation with the lip abutting the rear face of the housing and a second orientation wherein the second end of the clip is distanced from the housing. Working in conjunction with the clip is a neck strap having a pair of ends coupled to the top face of the housing for defining a closed loop for being looped about a neck of a user. For receiving the audio signals from the microphone, an input port is situated on the side face of the housing. The microphone is adapted to releasably receive the jack of the coiled cord and further receive the audio signals therefrom. It should be noted that the input port has a triangular cut out formed therein for receiving the triangular extent of the locking mechanism thereby precluding the inadvertent removal of the jack. A speaker is situated on the front face of the housing and connected to the input port for emitting the audio signals therefrom. For controlling the volume of the audio signals emitted from the speaker, a volume sliding switch is included. Such sliding switch is positioned on the side face of the housing and connected between the input port and the speaker. A light emitting diode is situated on the side face of the housing for illuminating upon the actuation of the amplification system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new HANDS-FREE AMPLIFICATION SYSTEM apparatus and method which has many of the advantages of the amplification systems mentioned heretofore and many novel features that result in a new HANDS-FREE AMPLIFICATION SYSTEM which is not anticipated, rendered obvious, suggested, or even implied by any of the prior art amplification systems, either alone or in any combination thereof.

It is another object of the present invention to provide a new HANDS-FREE AMPLIFICATION SYSTEM which may be easily and efficiently manufactured and marketed.

It is a further object of the present invention to provide a new HANDS-FREE AMPLIFICATION SYSTEM which is of a durable and reliable construction.

An even further object of the present invention is to provide a new HANDS-FREE AMPLIFICATION SYSTEM which is susceptible of a low cost of manufacture with regard to both materials and labor, and which accordingly is then susceptible of low prices of sale to the consuming public, thereby making such HANDS-FREE AMPLIFICATION SYSTEM economically available to the buying public.

Still yet another object of the present invention is to provide a new HANDS-FREE AMPLIFICATION SYSTEM which provides in the apparatuses and methods of the prior art some of the advantages thereof, while simultaneously overcoming some of the disadvantages normally associated therewith.

Still another object of the present invention is to provide a new HANDS-FREE AMPLIFICATION SYSTEM for mounting an amplification system on a user without interfering with various other equipment being concurrently worn.

Even still another object of the present invention is to provide a new HANDS-FREE AMPLIFICATION SYSTEM that includes a microphone for receiving audio signals from an ear of a user when the user vocalizes. Next provided is a cord having a first end connected to the microphone and a second end with a jack formed thereon. Also included is an amplifier housing having a rectilinear configuration with a square front face, a square rear face, a rectangular top face, a rectangular bottom face, and a pair of rectangular side faces coupled therebetween. A spring biased rectangular clip is included having a first end hingably coupled to the rear face of the housing adjacent the top face thereof. The clip has an unbiased orientation with a second end abutting the rear face of the housing and a second orientation wherein the second end of the clip is distanced from the housing. An input port is adapted to releasably receive the jack of the coiled cord and further receive the audio signals. Finally, a speaker is situated on the front face of the housing and connected to the input port for emitting the audio signals therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
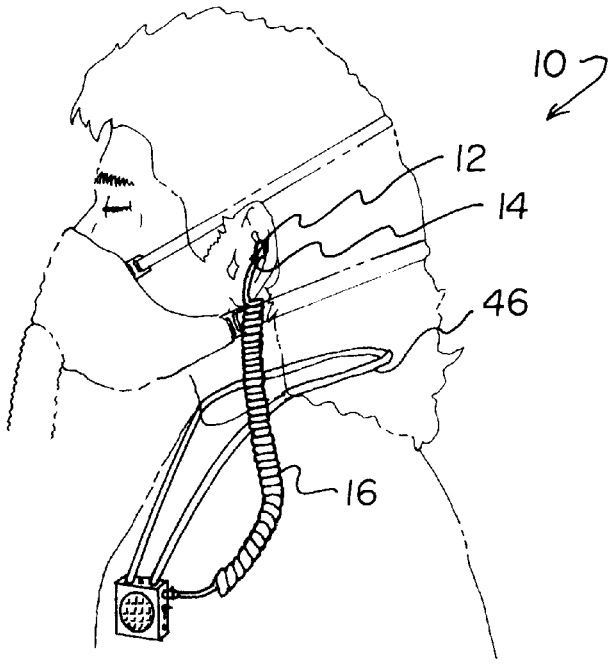
FIG. 1 is a side view of a new HANDS-FREE AMPLIFICATION SYSTEM according to the present invention.

With reference now to the drawings, and in particular to FIGS. 1 through 4 thereof, a new HANDS-FREE AMPLIFICATION SYSTEM embodying the principles and concepts of the present invention and generally designated by the reference numeral 10 will be described.

The system 10 of the present invention is adapted for use with a respirator, face mounted air filter, or the like. During use of such devices, vocalization is usually muffled.

As shown in FIG. 1, a microphone 12 is provided including an earpiece 14. Such earpiece is adapted to be frictionally situated within an ear of a user. In use, the microphone serves to receive audio signals when the user vocalizes.

Next provided is a coiled cord 16 having a first end connected to the microphone and a second end having a ⅛ inch jack 18 formed thereon. In the preferred embodiment, the cord is coiled along an entire length thereof. Such jack is equipped with a locking mechanism 20. The locking mechanism includes a tab 22 with a first end 26 coupled to an interior surface of the jack. An arcuate extent 28 extends through a first opening 30 in the jack. Such first opening is situated a first distance from the second end of the cord. The tab further has a triangular extent 32 extending through a second opening 34 in the jack a second distance from the second end of the cord which is greater than the first distance. By this structure, the triangular extent is adapted to lower within the second opening upon the depression of the arcuate portion.

Figure 2:
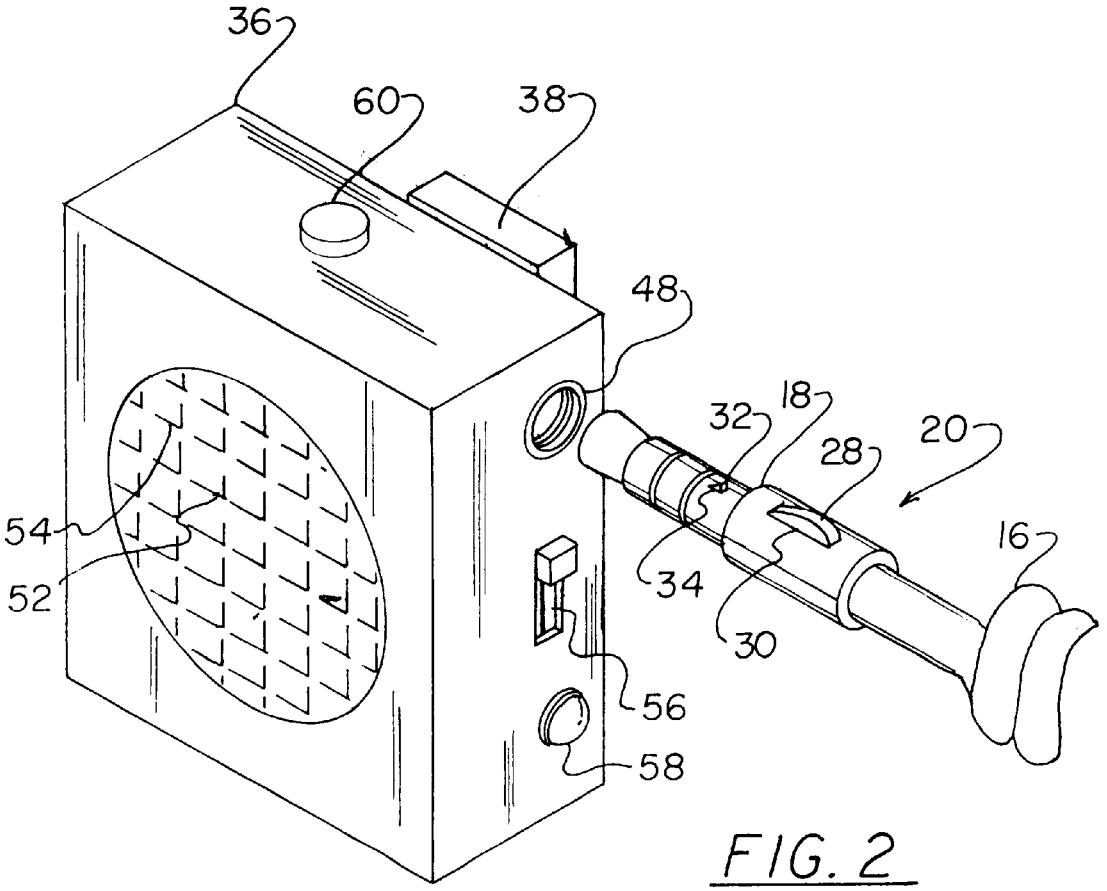
FIG. 2 is a perspective view of the present invention.
Figure 3:
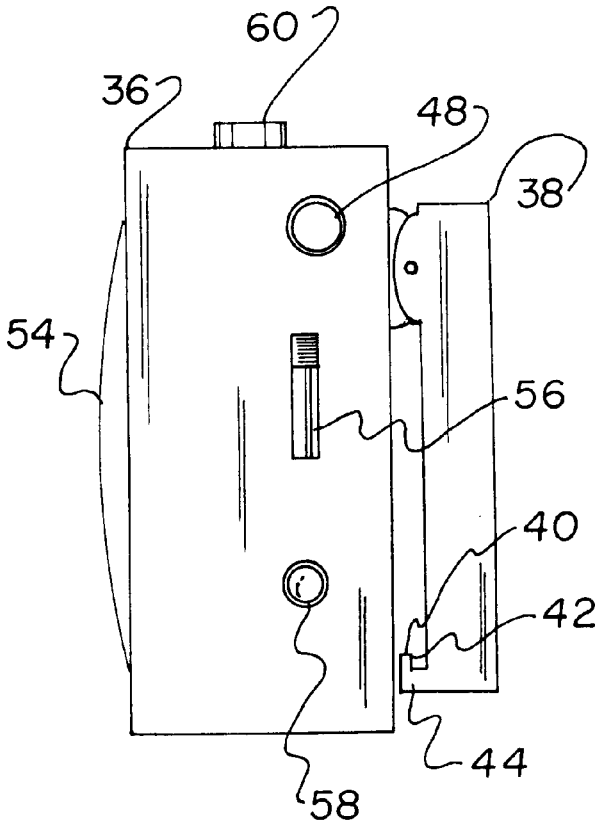
FIG. 3 is a side view of the housing of the present invention.
Figure 4:
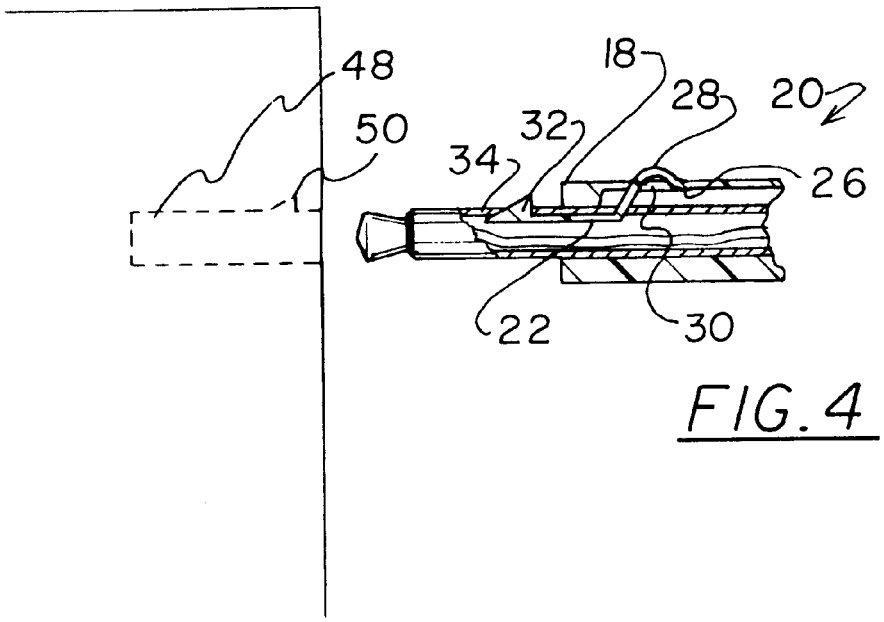
FIG. 4 is a side view of the jack and input port of the present invention.

As shown in FIGS. 2 & 3, an amplifier housing 36 is provided having a rectilinear configuration. The housing has a generally square front face, a generally square rear face, a rectangular top face, a rectangular bottom face, and a pair of rectangular side faces coupled therebetween. Ideally, the housing is constructed from a heat resistant plastic and has a height of 3 inches, a length of 2 inches, and a width of 1.5 inches.

Shown in FIG. 3 is a spring biased rectangular clip 38 having a first end hingably coupled to the rear face of the housing adjacent the top face thereof. The clip has an L-shaped lip 40 formed on a second end thereof. As such, a first portion 42 of the lip is situated in parallel with the clip and a second portion 44 is situated perpendicular with respect thereto. In use, the clip has an unbiased orientation with the lip abutting the rear face of the housing and a second orientation wherein the second end of the clip is distanced from the housing.

Working in conjunction with the clip is a neck strap 46 having a pair of ends coupled to the top face of the housing for defining a closed loop for being strung about a neck of a user. The length of the loop is preferably that which allows the housing to reside on a chest of the user during use. It should be understood that the foregoing coupling mechanisms are critical to maintain the housing in a proper orientation during use so as not to interfere with any other equipment the user may be wearing.

For receiving the audio signals from the microphone, an input port 48 is situated on the side face of the housing. The microphone is adapted to releasably receive the jack of the coiled cord and further receive the audio signals therefrom. It should be noted that the input port has a triangular cut out 50 formed therein for receiving the triangular extent of the locking mechanism thereby precluding the inadvertent removal of the jack.

A speaker 52 is situated on the front face of the housing and connected to the input port for emitting the audio signals therefrom. For protection purposes, the speaker may have a grill 54 formed thereon.

For controlling the volume of the audio signals emitted from the speaker, a volume sliding switch 56 is included. Such sliding switch is positioned on the side face of the house between connected between the input port and the speaker. Various means may be employed to afford the foregoing amplification. For example, an operation amplifier or the like may be utilized.

A light emitting diode 58 is situated on the side face of the housing for illuminating upon the actuation of the amplification system. Preferably, such actuation is effected when the jack is inserted within the input port. As an option, the present amplification system may be equipped with an alarm button 60 situated on the top face of the housing. Upon the depression of the alarm button, a high pitched loud audible alarm is emitted for drawing the attention of bystanders when loud vocalizing is not possible.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An amplification system for use in conjunction with a device which precludes readily access to a mouth of a user comprising, in combination:

a microphone including an earpiece adapted to be frictionally situated within an ear of a user for receiving audio signals when the user vocalizes;

a coiled cord having a first end connected to the microphone and a second end with a jack formed thereon having a locking mechanism, the locking mechanism including a tab with a first end coupled to an interior surface of the jack, an arcuate extent extending through a first opening in the jack a first distance from the second end thereof, and a triangular extent extending through a second opening in the jack a second distance from the second end thereof which is greater than the first distance, whereby the triangular extent is adapted to lower within the second opening upon the depression of the arcuate portion;

an amplifier housing having a rectilinear configuration with a square front face, a square rear face, a rectangular top face, a rectangular bottom face, and a pair of rectangular side faces coupled therebetween;

a spring biased rectangular clip having a first end hingably coupled to the rear face of the housing adjacent the top face thereof, the clip having an L-shaped lip formed on a second end thereof, the clip having an unbiased orientation with the lip abutting the rear face of the housing and a second orientation wherein the second end of the clip is distanced from the housing;

a neck strap having a pair of ends coupled to the top face of the housing for defining a closed loop for being looped about a neck of a user;

an input port adapted to releasably receive the jack of the coiled cord and further receive the audio signals therefrom, the input port having a triangular cut out formed therein for receiving the triangular extent of the locking mechanism for precluding the inadvertent removal of the jack;

a speaker situated on the front face of the housing and connected to the input port for emitting the audio signals therefrom;

a volume sliding switch positioned on the side face of the housing and connected between the input port and the speaker for controlling the volume of the audio signals emitted from the speaker; and a light emitting diode situated on the side face of the housing for illuminating upon the actuation of the amplification system.

2. An amplification system for use in conjunction with a device which precludes readily access to a mouth of a user comprising, in combination:

a microphone for receiving audio signals from an ear of a user when the user vocalizes;

a cord having a first end connected to the microphone and a second end with a jack formed thereon;

an amplifier housing with a square front face, a rear face, a top face, a bottom face, and a pair of side faces coupled therebetween;

a spring biased clip having a first end hingably coupled to the rear face of the housing adjacent the top face thereof, the clip having an unbiased orientation with a second end abutting the rear face of the housing and a second orientation wherein the second end of the clip is distanced from the housing;

an input port adapted to releasably receive the jack of the coiled cord and further receive the audio signals;

a speaker situated on the front face of the housing and connected to the input port for emitting the audio signals therefrom.

3. An amplification system as set forth in claim 2 and further including a volume switch positioned on the side face of the housing and connected between the input port and the speaker for controlling the volume of the audio signals emitted from the speaker.

4. An amplification system as set forth in claim 2 and further including a light emitting diode situated on the side face of the housing for illuminating upon the actuation of the amplification system.

5. An amplification system as set forth in claim 2 wherein the jack has a locking mechanism, the locking mechanism including a tab with a first end coupled to an interior surface of the jack, an arcuate extent extending through a first opening in the jack a first distance from the second end thereof, and a triangular extent extending through a second opening in the jack a second distance from the second end thereof which is greater than the first distance, whereby the triangular extent is adapted to lower within the second opening upon the depression of the arcuate portion, whereby the input port includes a triangular cut out formed therein for receiving the triangular extent of the locking mechanism for precluding the inadvertent removal of the jack.

6. An amplification system as set forth in claim 2 wherein the cord is coiled.

7. An amplification system as set forth in claim 2 wherein the second end of the clip has an L-shaped lip formed thereon.

8. An amplification system as set forth in claim 2 wherein the microphone includes an earpiece adapted to be frictionally situated within the ear of the user.

9. An amplification system for use in conjunction with a device which precludes readily access to a mouth of a user comprising, in combination:

a microphone for receiving audio signals from an ear of a user when the user vocalizes;

a cord having a first end connected to the microphone and a second end with a jack formed thereon;

an amplifier housing having a configuration with a front face, a rear face, a top face, a bottom face, and a pair of side faces coupled therebetween;

a neck strap having a pair of ends coupled to the housing for defining a closed loop for being looped about a neck of a user;

an input port adapted to releasably receive the jack of the coiled cord and further receive the audio signals;

a speaker situated on the front face of the housing and connected to the input port for emitting the audio signals therefrom.

* * * * *